US009295860B2

(12) United States Patent
Koban et al.

(10) Patent No.: US 9,295,860 B2
(45) Date of Patent: Mar. 29, 2016

(54) METHODS OF REDUCING FLAME PROPOGATION IN SYSTEMS WITH A FLAMMABLE REFRIGERANT

(75) Inventors: Mary E Koban, Chadds Ford, PA (US); Thomas Joseph Leck, Hockessin, DE (US); Barbara Haviland Minor, Elkton, MD (US)

(73) Assignee: THE CHEMOURS COMPANY FC, LLC, Wilmington, DE (US)

( * ) Notice: Subject to any disclaimer, the term of this patent is extended or adjusted under 35 U.S.C. 154(b) by 335 days.

(21) Appl. No.: 13/978,730

(22) PCT Filed: Jan. 11, 2012

(86) PCT No.: PCT/US2012/020936

§ 371 (c)(1),
(2), (4) Date: Jul. 9, 2013

(87) PCT Pub. No.: WO2012/097060

PCT Pub. Date: Jul. 19, 2012

(65) Prior Publication Data

US 2013/0284464 A1 Oct. 31, 2013

Related U.S. Application Data

(60) Provisional application No. 61/431,587, filed on Jan. 11, 2011.

(51) Int. Cl.

| | |
|---|---|
| ***A62C 4/00*** | (2006.01) |
| *A62C 3/06* | (2006.01) |
| *A62C 3/07* | (2006.01) |

(52) U.S. Cl.
CPC ... *A62C 4/00* (2013.01); *A62C 3/06* (2013.01); *A62C 3/07* (2013.01)

(58) Field of Classification Search
CPC ..... A62C 4/00; A62C 3/06; A62C 3/07
USPC ..... 62/77, 149, 292; 169/43
See application file for complete search history.

(56) References Cited

U.S. PATENT DOCUMENTS

| | | | | |
|---|---|---|---|---|
| 3,961,900 | A * | 6/1976 | Gintella et al. | 422/96 |
| 4,958,554 | A | 9/1990 | Spaeth | |
| 5,203,296 | A * | 4/1993 | Hart | 123/198 D |
| 5,415,233 | A | 5/1995 | Roussakis et al. | |
| 7,056,114 | B2 * | 6/2006 | Brooker | 431/346 |
| 7,150,258 | B1 | 12/2006 | McDonald | |
| 2008/0190124 | A1 | 8/2008 | McConnell et al. | |
| 2008/0289353 | A1 * | 11/2008 | Maruya et al. | 62/292 |

(Continued)

FOREIGN PATENT DOCUMENTS

| | | |
|---|---|---|
| DE | 523 513 C | 2/1931 |
| EP | 0 117 864 A1 | 9/1984 |

OTHER PUBLICATIONS

PCT International Search Report and Written Opinion dated Nov. 16, 2012.

*Primary Examiner* — Mohammad M Ali

(57) ABSTRACT

The present invention provides methods for reducing the propagation of a flame to or from a refrigerant source and an ignition source in or adjacent to a cooling system, comprising positioning a metal mesh flame arrestor between said refrigerant source and said ignition source. The methods allow the use of flammable refrigerants with reduced risk of fire.

14 Claims, 3 Drawing Sheets

(56) References Cited

U.S. PATENT DOCUMENTS

2009/0099274 A1* 4/2009 Van Der Puy et al. ..... 521/110
2009/0272134 A1* 11/2009 Hulse et al. ..... 62/112
2009/0278097 A1* 11/2009 Leck et al. ..... 252/602
2010/0012882 A1* 1/2010 Sherman et al. ..... 252/68
2010/0326129 A1* 12/2010 Moriwaki et al. ..... 62/498

* cited by examiner

METHODS OF REDUCING FLAME PROPOGATION IN SYSTEMS WITH A FLAMMABLE REFRIGERANT

FIELD OF THE INVENTION

The disclosed invention is in the field of flame arrestors for use with refrigerant and air conditioning systems, particularly mobile and stationary refrigerant and air conditioning systems.

BACKGROUND OF THE INVENTION

The refrigeration industry has been working for the past few decades to find replacement refrigerants for the ozone depleting chlorofluorocarbons (CFCs) and hydrochlorofluorocarbons (HCFCs) being phased out as a result of the Montreal Protocol. The solution for most refrigerant producers has been the commercialization of hydrofluorocarbon (HFC) refrigerants. The new HFC refrigerants, including HFC-134a, have zero ozone depletion potential and thus are not affected by the current regulatory phase out as a result of the Montreal Protocol.

Further environmental regulations may ultimately cause global phase out of certain HFC refrigerants. Currently, industry is facing regulations relating to global warming potential (GWP) for refrigerants used in mobile air conditioning. Should the regulations be more broadly applied in the future, for instance for stationary air conditioning and refrigeration systems, an even greater need will be felt for refrigerants that can be used in all areas of the refrigeration and air-conditioning industry. In order to achieve low GWP, hydrofluorocarbon and hydrocarbon refrigerants with various levels of flammability have been proposed Refrigerant systems, such as air conditioning, refrigeration or heat pump systems, using flammable refrigerants may leak or otherwise escape from the refrigerant container or tubing due to vehicle accident or system malfunction. When the refrigerants are exposed to potential ignition sources, such as those within an automobile engine compartment, the potential for fire is present. For example, in the event that the refrigerant lines or containers are cut, punctured, ruptured, or otherwise damaged, such as in an automobile accident, the flammable refrigerants may contact certain ignition sources and thus lead to a fire. Systems are needed to prevent ignition of refrigerants and to otherwise mitigate the spread of a fire to other nearby combustible materials that may further damage property or materials within the vicinity of the ignition or be a risk to passengers.

SUMMARY OF THE INVENTION

The present invention provides a method for reducing the propagation of a flame to or from a refrigerant source and an ignition source in or adjacent to a cooling system, comprising positioning a metal mesh flame arrestor between said refrigerant source and said ignition source.

The general description and the following detailed description are exemplary and explanatory only and are not restrictive of the invention, as defined in the appended claims.

BRIEF DESCRIPTION OF THE DRAWINGS

For the purpose of illustrating the invention, there are shown in the drawings exemplary embodiments of the invention; however, the invention is not limited to the specific methods, compositions, and devices disclosed. In addition, the drawings are not necessarily drawn to scale. In the drawings.

DETAILED DESCRIPTION OF ILLUSTRATIVE EMBODIMENTS

Figure 1:
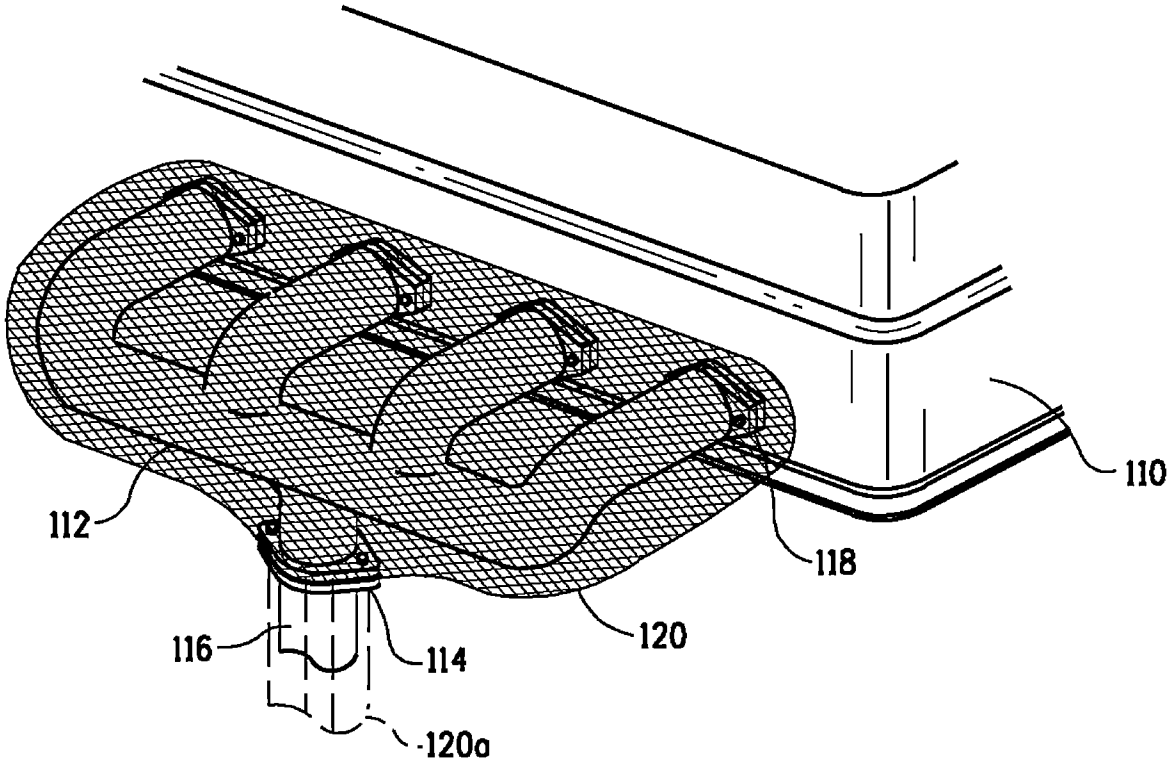
FIG. 1 illustrates one embodiment of the present invention directed to an automobile exhaust manifold, in which the manifold components are covered with a flame arrestor.

It is to be understood that this invention is not limited to the specific devices, methods, applications, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. The term "plurality", as used herein, means more than one. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

It is to be appreciated that certain features of the invention which are, for clarity, described herein in the context of separate embodiments, may also be provided in combination in a single embodiment. Conversely, various features of the invention that are, for brevity, described in the context of a single embodiment, may also be provided separately or in any subcombination. Further, reference to values stated in ranges include each and every value within that range.

Various ignition sources may exist in cooling systems using refrigerant working fluids. As an example, refrigerant is contained in an air conditioning system for an automobile that is contained within the automobile's engine compartment. These sources include, for example, fuses, electrical heaters, engine exhaust manifolds, catalytic converters, or turbo chargers, and the hot surfaces associated with such sources. These ignition sources may be where a fire or spark starts or develops or potentially where a flame may travel.

Cooling systems include refrigeration systems, air conditioning systems, and heat pump systems, as well as, combined air conditioning and heating systems, such as integrated heating/cooling systems that include a furnace. These systems include air conditioners, freezers, refrigerators, heat pumps, water chillers, flooded evaporator chillers, direct expansion chillers, walk-in coolers, heat pumps, mobile refrigerators, mobile air conditioning units and combinations thereof.

As used herein, mobile heat transfer system refers to any refrigeration, air conditioner, or heating apparatus incorporated into a transportation unit for the road, rail, sea or air. In addition, mobile refrigeration or air conditioner units, include those apparatus that are independent of any moving carrier and are known as "intermodal" systems. Such intermodal systems include "container" (combined sea/land transport) as well as "swap bodies" (combined road/rail transport).

As used herein, stationary heat transfer systems are systems that are fixed in place during operation. A stationary heat transfer system may be associated within or attached to buildings of any variety or may be standalone devices located out of doors, such as a drink or snack vending machine. These stationary applications may be stationary air conditioning and heat pumps (including but not limited to chillers, high temperature heat pumps, residential air conditioners, commercial or industrial air conditioning systems, and including window, ductless, ducted, packaged terminal, chillers, and those exterior but connected to the building such as rooftop systems). In stationary refrigeration applications, the disclosed compositions may be useful in equipment including commercial, industrial or residential refrigerators and freezers, ice machines, self-contained coolers and freezers, flooded evaporator chillers, direct expansion chillers, walk-in and reach-in coolers and freezers, and combination systems. In some embodiments, the disclosed compositions may be used in supermarket refrigeration systems. Additionally, stationary systems include secondary loop systems that utilize a primary refrigerant and a secondary heat transfer fluid.

A flammable refrigerant is a refrigerant with the ability to ignite and/or propagate a flame in the presence of air. The flammability of a refrigerant is determined under test conditions specified in ASTM (American Society of Testing and Materials) E681. The test data indicates if the composition is flammable at specified temperatures (as designated by ASHRAE (American Society of Heating, Refrigerating and Air-Conditioning Engineers) in ASHRAE Standard 34).

Examples of refrigerant sources include automotive air conditioning or heat pump systems and stationary furnaces or air conditioning/furnace combination systems. Such systems may comprise refrigerants that comprise one or more tetrafluoropropenes. The present invention is particularly useful in arresting the propagation of flames exposed to low GWP tetrafluoropropene refrigerants, such as 2,3,3,3-tetrafluoropropene (HFO-1234yf); cis-1,3,3,3-tetrafluoropropene (cis-HFO-1234ze); trans-1,3,3,3-tetrafluoropropene (trans-HFO-1234ze); cis-1,2,3,3-tetrafluoropropene (cis-HFO-1234ye); trans-1,2,3,3-tetrafluoropropene (trans-HFO-1234ye); 1,1,2,3-tetrafluoropropene (HFO-1234yc); and 1,1,3,3-tetrafluoropropene (HFO-1234zc). Other types of flammable refrigerants that may be found in engine compartments include 1,1-difluoroethane (HFC-152a) and difluoromethane (HFC-32). Additionally, flammable refrigerants that may be found in engine compartments include mixtures of tetrafluoropropenes with difluoromethane (HFC-32) and/or 1,1-difluoroethane (HFC-152a). In one embodiment, the refrigerant comprises 2,3,3,3-tetrafluoropropene. In another embodiment, the refrigerant comprises trans-1,3,3,3-tetrafluoropropene. In another embodiment, the refrigerant comprises difluoromethane. In another embodiment, the refrigerant comprises 1,1-difluoroethane.

Containment systems are needed to prevent the ignition of flammable refrigerants or to contain or mitigate the spread of fire from the ignition of the refrigerant. For example, refrigerant may leak from tubing or a vessel holding the refrigerant and the refrigerant may ignite when exposed to a flame, hot surface, or spark. The present disclosure relates to the use of particular flame arrestors, such as those useful in arresting the propagation of flames exposed to tetrafluoropropene or other flammable refrigerants as described above.

A flame arrestor functions by forcing a flame front through channels too narrow to permit the continuance of a flame. These passages can be regular, like metal mesh (e.g., wire mesh) or a sheet metal plate with punched holes, or irregular, such as those in random packing. The required size of the channels needed to stop a flame front can vary significantly, depending on the flammability properties of the leaking refrigerant.

Metal mesh flame arrestors are particularly useful in connection with the present invention. These arrestors typically comprise planar sheets but may also take other shapes depending on the application of interest. For example, the metal mesh flame arrestor may be flexible so as to wrap around a particular ignition or refrigerant source.

The flame arrestors of the present invention may be comprised of metals such as 316 stainless steel, 304 stainless steel, carbon steel, aluminum, or copper. In one embodiment, the mesh has an open area of about 60% or less, more preferably 52% or less. In certain embodiments, the metal mesh flame arrestors with symmetrical hole sizes have an opening width of 0.028 inches or less, more preferably 0.023 inches or less.

The mesh size is indicated by "mesh per inch". The mesh per inch dimension is the number of openings (or channels, as described above) within an inch of the wire sheet. This dimension is expressed as two numbers, such as 3×3, which means there are three openings horizontally and three openings vertically in one inch. Open area (or open space) is the percent of the screen area that is made up of openings (or channels) in the mesh.

In another embodiment of the invention, two or more metal mesh sheets may be used. For example, the two or more metal mesh sheets may be positioned so that the mesh holes of each sheet are lined up in an offset position, and may define various opening widths and open areas effective for reducing the propagation of a flame. In certain embodiments, the two or more metal mesh screens may be lined up to create an overall metal mesh flame arrestor with a preferred open area of about 63% or less, and an opening width of the mesh of about 0.132 inches or less, more preferred is an open area of about 56% or less and width of mesh of about 0.075 inches or less.

The flame arrestor is typically positioned between the refrigerant source and the ignition source, preferably close to the ignition source to prevent significant propagation of the flame away from the ignition source. For example, the possibility of engine damage may be reduced by preventing a flame from propagating from an automobile exhaust manifold. This may be accomplished by wrapping a metal mesh flame arrestor around an exhaust manifold, thereby prohibiting the passage of flame away from the exhaust manifold in the event the hot manifold is exposed to leaking refrigerant and an ignition occurs.

In some embodiments, the distance of the metal mesh from the ignition source will vary from a few millimeters to a few centimeters. In one embodiment, the distance between the metal mesh and the ignition source is from about 2 mm to about 5 cm. In another embodiment, the distance between the metal mesh and the ignition source is from about 5 mm to about 3 cm. In another embodiment, the distance between the metal mesh and the ignition source is from about 1 cm to about 2 cm. FIG. 1 illustrates an embodiment where the metal mesh flame arrestor is wrapped around a manifold. Therefore, if there is a leak from the air conditioning system and the refrigerant vapor or liquid travels through the flame arrestor mesh and ignites with a hot surface, such as an exhaust manifold (or other ignition source), the flame front may attempt to spread, but can be stopped from passing back through the metal mesh flame arrestor if the hole size, for example, is correctly designed for the type of flame encountered.

With reference to FIG. 1, a flame arrestor is shown in one embodiment of a mobile system including an air conditioner containing refrigerant. In particular, an exhaust manifold of an automobile is shown in FIG. 1 with a flame arrestor attached. The engine block 110 has multiple outlets for exhaust air. These outlets are connected to the exhaust manifold 112. The exhaust air flows out of the engine block through the outlets and into the exhaust manifold. The multiple exhaust air streams are merged into a single steam that flows into the exhaust pipe 116. The metal mesh flame arrestor 120 covers the entire exhaust manifold 112 from the connections 118 for the engine block to the connection 114 for the exhaust pipe. In another embodiment, the metal mesh flame arrestor may optionally be extended to cover at least some portion of the exhaust pipe 116, shown in FIG. 1 as 120*a*. The metal mesh flame arrestor may be attached by any means sufficient to hold it in place. Means for connecting the metal mesh flame arrestor to an exhaust manifold, for example, include welding (e.g., continuous welds or spot welds), brazing, and fasteners such as screws or bolts. In one embodiment, existing fasteners, for instance the bolts used to attach the exhaust manifold to the engine block at 118 in FIG. 1 may be utilized. In another embodiment, the flame arrestor may be incorporated in the design of new systems. FIG. 1 shows a single metal mesh flame arrestor covering the entire exhaust manifold, however in other embodiments, individual metal mesh flame arrestors may surround each pipe of the exhaust manifold.

Figure 2:
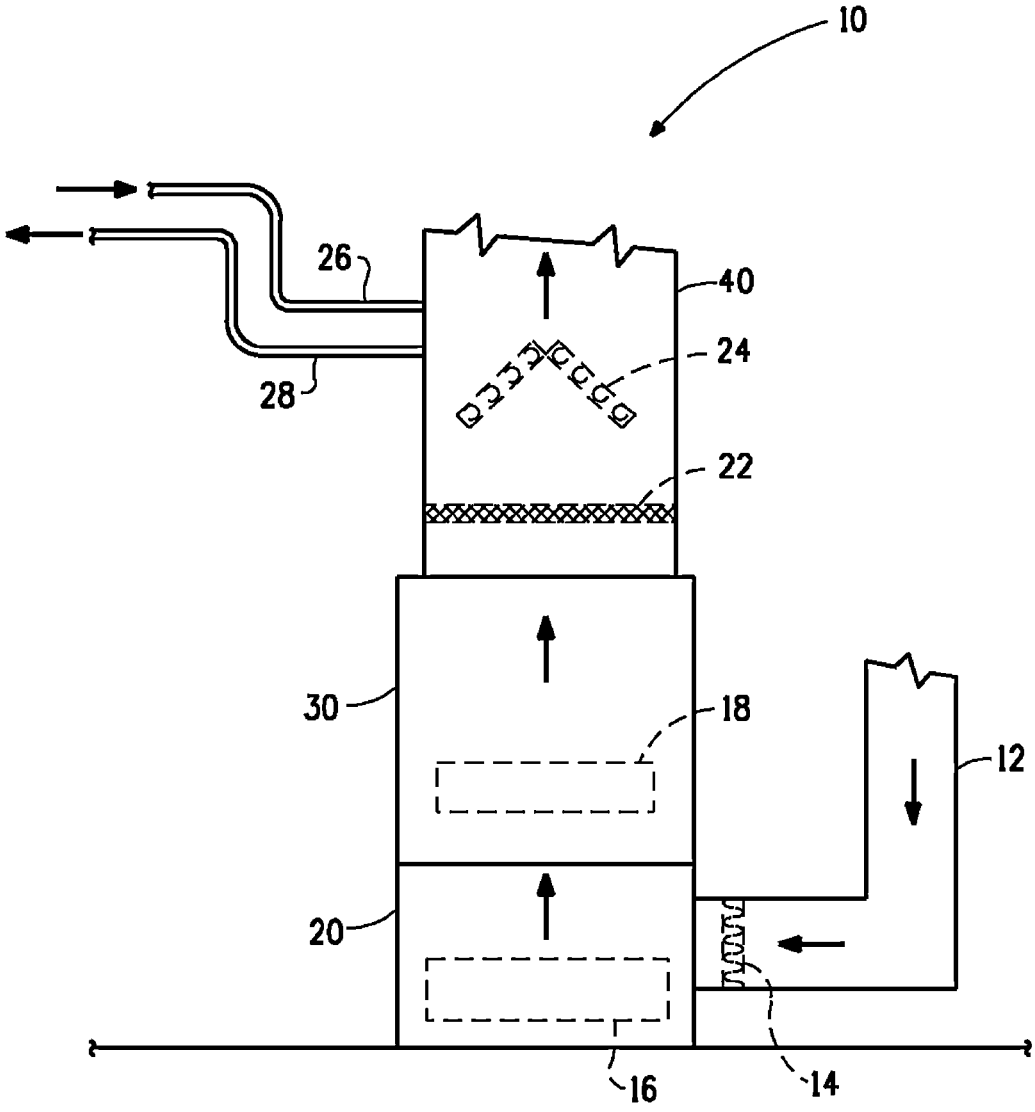
FIG. 2 illustrates one embodiment of the present invention directed to a stationary heating and cooling system for, for instance, a residential furnace/air conditioner, in which the flame arrestor is positioned between the heat source of the furnace and the evaporator.

FIG. 2 shows the application of a flame arrestor in a stationary heating/air conditioning system 10 (sometimes referred to as an integrated heating/cooling unit). In FIG. 2, 12 is the return air duct from a space to be heated or cooled, for instance a house. Return air from the space flows through the duct 12 through a filter 14 into a blowing unit 20. The blowing unit contains a blower or fan to move the aft into the furnace 30 and from there through the evaporator unit 40 and into the ductwork that routes the air into the house or other space to be heated. The furnace includes a heating element 18, which may be a gas (e.g., propane or natural gas) or oil flame or electric heating element or coil. The evaporator unit 40 includes the metal mesh flame arrestor 22 and an evaporator 24, which contains refrigerant. Refrigerant flows into the evaporator through line 26 from an outside unit comprising a compressor and condenser to complete the vapor compression cooling/heating circuit and then flows back to the outside unit through line 28. In the event of a refrigerant leak, any flame from the furnace unit would be arrested and prevented from extending past the metal mesh flame arrestor.

The evaporator unit of the system shown in FIG. 2 may be part of a dedicated air conditioner system (for just cooling) or part of a heat pump system that provides cooling and heating (when outside temperatures allow). In the case of a heat pump, the furnace would serve as a back-up heating system for lower outside temperature conditions.

In an alternative embodiment, the metal mesh flame arrestor may encapsulate a refrigerant source, such that if there is a leak from tubing that circulates flammable refrigerant material, the metal mesh can restrict any damage from ignition of the refrigerant to substantially within the refrigerant source and mitigate damage to areas beyond the refrigerant source.

When ranges are used herein for physical properties, such as mesh size, all combinations, and subcombinations of ranges for specific embodiments therein are intended to be included.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

EXAMPLES

Example 1

Refrigerant Flame Arrestor Tests

Figure 3:
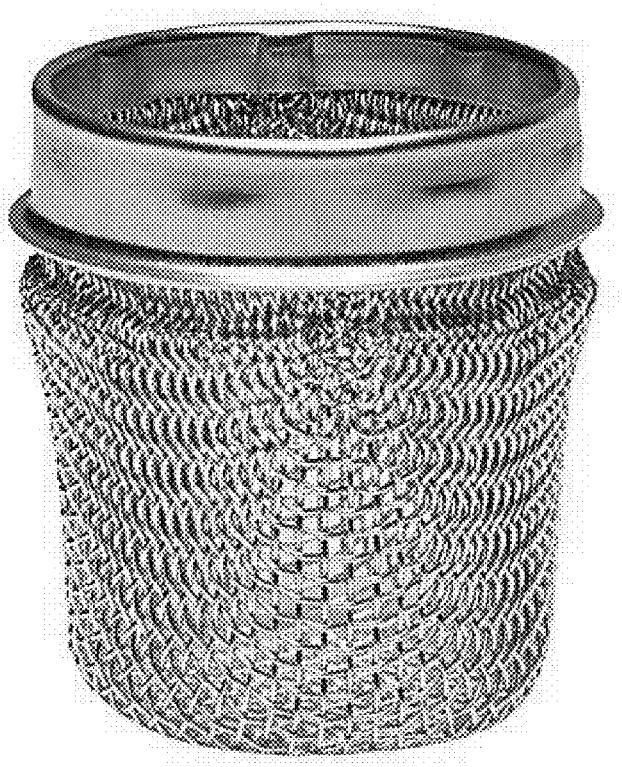
FIG. 3 is a picture of the cup-shaped flame arrestor used in Examples 1 and 2.

An 8 oz tin plated aerosol can was filled with about 175 grams of refrigerant compositions and fitted with an Acc-U-Sol actuator (Precision Valve Company). A standard plumber's candle, 3.5 inches tall, was lit. A cup shaped flame arrestor with a closed top, a height of 45 mm, a base diameter of 40 mm and hole sizes varying from 0.5 mm to 1.2 mm (see FIG. 3) was placed over the flame to cover the flame and wick. Refrigerant compositions were sprayed liquid phase horizontally from about 10 inches away from the candle at the height of the flame and flame extension behavior was observed. Results are shown in Table 1 below:

TABLE 1

| Refrigerant Composition | Refrigerant Composition (wt %) | Flame Arrestor Present? | Observation |
|---|---|---|---|
| HFO-1234yf | 100 | No | ~1 inch flame extension then self-extinguished |
| HFC-152a | 100 | No | ~14 inch flame extension |
| HFO-1234yf/ HFC-152a | 50/50 | No | ~8 inch flame extension |
| HFO-1234yf | 100 | Yes | Flame stayed contained inside arrestor |
| HFC-152a | 100 | Yes | Flame extended beyond arrestor ~2 inches, then bash back to aerosol can |
| HFO-1234yf/ HFC-152a | 50/50 | Yes | Flame stayed contained inside arrestor |

Results show the flame arrestor is capable of containing a flame exposed to HFO-1234yf or HFO-1234yf/HFC-152a mixtures and thereby improving safety of these refrigerant compositions.

Example 2

Refrigerant/Lubricant Flame Arrestor Tests

An 8 ounce tin plated aerosol can was filled with about 175 grams of refrigerant and lubricant compositions and fitted with an Acc-U-Sol actuator, A standard plumbers candle, 3.5 inches tall, was it and the flame arrestor of Example 1 was placed over the flame to cover the flame and wick. The compositions were sprayed liquid phase horizontally from about 10 inches away from the candle at the height of the flame and flame extension behavior was observed. Results are shown in Table 2 below:

TABLE 2

| Refrigerant Composition | Refrigerant Composition (wt %) | Lubricant Composition UCON 244 PAG (wt %) | Flame Arrestor Present? | Observation |
|---|---|---|---|---|
| HFO-1234yf | 99 | 1 | No | ~1 inch flame extension then extinguished |
| HFO-1234yf | 97 | 3 | No | ~1.5 inch flame extension then extinguished |
| HFO-1234yf | 93 | 7 | No | ~4.5 inch flame extension then extinguished |
| HFO-1234yf | 99 | 1 | Yes | Flame stayed contained inside arrestor, then self-extinguished |
| HFO-1234yf | 97 | 3 | Yes | Flame stayed contained inside arrestor |
| HFO-1234yf | 93 | 7 | Yes | Flame stayed contained inside arrestor |

Results show the flame arrestor is effective at containing a flame exposed to HFO-1234yf/lubricant mixtures and thereby improving safety of these refrigerant/lubricant compositions. UCON-244 is a polyalkylene glycol compressor lubricant supplied by Dow (Midland, Mich.).

Example 3

Stainless Steel Flat Woven Screen Flame Arrestor Tests

An 8 oz tin plated aerosol can was filled with about 175 grams of refrigerant compositions and fitted with an Acc-U-Sol actuator. A standard plumber's candle, 3.5 inches tall, was lit. Flat woven 304 stainless steel wire screens of varying mesh size, opening size and wire diameter (McMaster-Carr, Elmhurst, Ill.) were placed vertically next to the candle on the side away from the aerosol can. The refrigerant compositions were sprayed liquid phase horizontally from about 10 inches away from the candle at the height of the flame. The flame extension was observed as to whether the flame traveled through the screen or was arrested upon spraying. Results are shown in Table 3 below:

TABLE 3

| Material | Material Type | Mesh Size (per inch) | Wire Diameter (in) | Opening Width (in) | Open Area (%) | Refrigerant | Was flame arrested? (Y or N) |
|---|---|---|---|---|---|---|---|
| 304SS | Wire screen Thick Wire | 2 × 2 | 0.063 | 0.437 | 76.4 | t-1234ze | No |
| | | | | | | 1234yf | No |
| | | | | | | 32 | No |
| | | | | | | 152a | No |
| 304SS | Wire screen Thin Wire | 3 × 3 | 0.047 | 0.286 | 73.6 | t-1234ze | No |
| | | | | | | 1234yf | No |
| | | | | | | 32 | No |
| | | | | | | 152a | No |
| 304SS | Wire screen Thick Wire | 3 × 3 | 0.063 | 0.270 | 65.6 | t-1234ze | No |
| | | | | | | 1234yf | No |
| | | | | | | 32 | No |
| | | | | | | 152a | No |
| 304SS | Wire screen Thin Wire | 6 × 6 | 0.035 | 0.132 | 62.7 | t-1234ze | No |
| | | | | | | 1234yf | No |
| | | | | | | 32 | No |
| | | | | | | 152a | No |
| 304SS | Wire screen Thick Wire | 6 × 6 | 0.063 | 0.104 | 38.9 | t-1234ze | Yes |
| | | | | | | 1234yf | Yes |
| | | | | | | 32 | Yes |
| | | | | | | 152a | No |
| 304SS | Wire screen Thin Wire | 8 × 8 | 0.028 | 0.097 | 60.2 | t-1234ze | Yes |
| | | | | | | 1234yf | Yes |
| | | | | | | 32 | Yes |
| | | | | | | 152a | No |
| 304SS | Wire screen Thin Wire | 10 × 10 | 0.025 | 0.075 | 56.3 | t-1234ze | Yes |
| | | | | | | 1234yf | Yes |
| | | | | | | 32 | Yes |
| | | | | | | 152a | No |
| 304SS | Wire screen Thin Wire | 12 × 12 | 0.023 | 0.060 | 51.8 | t-1234ze | Yes |
| | | | | | | 1234yf | Yes |
| | | | | | | 32 | Yes |
| | | | | | | 152a | No |
| 304SS | Wire screen Thin Wire | 20 × 20 | 0.016 | 0.034 | 46.2 | t-1234ze | Yes |
| | | | | | | 1234yf | Yes |
| | | | | | | 32 | Yes |
| | | | | | | 152a | No |

The results show that stainless steel wire mesh with open area of about 60% or less will arrest flames from trans-HFO-1234ze, HFO-1234yf and HFC-32 which have relatively low flame propagation characteristics (burning velocity less than 10 cm/sec). This open area corresponds to a screen mesh size of 8×8 or greater.

Example 4

Aluminum Flat Woven Screen Flame Arrestor Tests

An 8 oz tin plated aerosol can was filled with about 175 grams of refrigerant compositions and fitted with an Acc-U-Sol actuator. A standard plumbers candle, 3.5 inches tall, was lit. Flat woven aluminum wire screen of varying mesh size, opening size and wire diameter (McMaster-Carr, Elmhurst, Ill.) was placed vertically next to the candle on the side away from the aerosol can. The refrigerant compositions were sprayed liquid phase horizontally from about 10 inches away from the candle at the height of the flame. The flame extension was observed as to whether the flame traveled through the screen or was arrested upon spraying. Results are shown in Table 4 below:

TABLE 4

| Material | Material Type | Mesh Size (per inch) | Wire Diameter (in) | Opening Width (in) | Open Area (%) | Refrigerant | Was flame arrested? (Y or N) |
|---|---|---|---|---|---|---|---|
| Aluminum | Wire screen Thick Wire | 2 × 2 | 0.063 | 0.437 | 76.4 | t-1234ze | No |
| | | | | | | 1234yf | No |
| | | | | | | 32 | No |
| | | | | | | 152a | No |
| Aluminum | Wire screen Thin Wire | 6 × 6 | 0.035 | 0.132 | 62.7 | t-1234ze | No |
| | | | | | | 1234yf | No |
| | | | | | | 32 | No |
| | | | | | | 152a | No |
| Aluminum | Wire screen Thin Wire | 8 × 8 | 0.028 | 0.097 | 60.2 | t-1234ze | Yes |
| | | | | | | 1234yf | No |
| | | | | | | 32 | Yes |
| | | | | | | 152a | No |
| Aluminum | Wire screen Thin Wire | 10 × 10 | 0.025 | 0.075 | 56.3 | t-1234ze | Yes |
| | | | | | | 1234yf | Yes |
| | | | | | | 32 | Yes |
| | | | | | | 152a | No |
| Aluminum | Wire screen Thin Wire | 12 × 12 | 0.023 | 0.06 | 51.8 | t-1234ze | Yes |
| | | | | | | 1234yf | Yes |
| | | | | | | 32 | Yes |
| | | | | | | 152a | No |
| Aluminum | Wire screen Thin Wire | 20 × 20 | 0.016 | 0.034 | 46.2 | t-1234ze | Yes |
| | | | | | | 1234yf | Yes |
| | | | | | | 32 | Yes |
| | | | | | | 152a | No |

The results show that aluminum wire mesh with open area of about 60% or less (8×8 mesh or greater) will arrest flames from trans-HFO-1234ze, and HFC-32 while mess with open area about 56% or less (10×10 mesh or greater) will arrest HFO-1234yf.

Example 5

Mosquito Screen as Flame Arrestor

An 8 oz tin plated aerosol can was filled with about 175 grams of refrigerant compositions and fitted with an Acc-U-Sol actuator. A standard plumbers candle, 3.5 inches tall, was lit. A flat aluminum mosquito screen was placed vertically next to the candle on the side away from the aerosol can. The refrigerant compositions were sprayed liquid phase horizontally from about 10 inches away from the candle at the height of the flame. The flame extension was observed as to whether the flame traveled through the screen or was arrested upon spraying. Results are shown in Table 5 below:

TABLE 5

| Material | Material Type | Mesh Size (per inch) | Wire Diameter (in) | Refrigerant | Flame prevented from travel thru screen? (Y or N) |
|---|---|---|---|---|---|
| Aluminum | Mosquito screen | 16 × 16 | 0.008 | trans-1234ze | Yes |
| Aluminum | Mosquito screen | 16 × 16 | 0.008 | 1234yf | Yes |
| Aluminum | Mosquito screen | 16 × 16 | 0.008 | 32 | Yes |

TABLE 5-continued

| Material | Material Type | Mesh Size (per inch) | Wire Diameter (in) | Refrigerant | Flame prevented from travel thru screen? (Y or N) |
|---|---|---|---|---|---|
| Aluminum | Mosquito screen | 16 × 16 | 0.008 | 152a | No |

Results show that a design as simple as a mosquito screen is also effective at arresting flames of trans-HFO-1234ze, HFO-1234yf and HFC-32.

Example 6

Two Layered Flame Arrestor Test

An 8 oz tin plated aerosol can was filled with about 175 grams of refrigerant compositions of the present invention and fitted with an Acc-U-Sol actuator, A standard plumbers candle, 3.5 inches tall, was lit. Two flat 304 SS woven screens were vertically positioned directly next to the candle with the screens overlapping each other and the holes offset. The screens were offset by centering the intersection of one wire screen in the open area between wires of the second wire screen. This arrangement was compared to a single screen which had failed in previous tests. The refrigerant compositions were sprayed liquid phase horizontally from about 10 inches away from the candle at the height of the flame. The flame extension was observed as to whether the flame traveled through the screen or was arrested upon spraying. Results are shown in Table 6 below:

TABLE 6

| Material | Material Type | Mesh Size (per inch) | Wire Diameter (in) | Opening Width (in) | Open Area (%) | Refrigerant | Was flame arrested? (Y or N) |
|---|---|---|---|---|---|---|---|
| 304SS | Wire screen, Single screen, Thin Wire | 6 × 6 | 0.035 | 0.132 | 62.7 | trans-1234ze | No |
| | | | | | | 1234yf | No |
| | | | | | | 32 | No |
| | | | | | | 152a | No |
| 304SS | Wire screen, Two screens overlapping, Thin Wire | 6 × 6 | 0.035 | 0.132 | 62.7 | trans-1234ze | Yes |
| | | | | | | 1234yf | Yes |
| | | | | | | 32 | Yes |
| | | | | | | 152a | No |

Results show metal mesh flame arrestors can also be effective when two screens are placed over each other with the holes lined up in an offset position to provide an additional path of resistance for the flame. The offset wire screens served to reduce the open area of the flame arrestor. This was effective for trans-HFO-1234ze, HFO-1234yf and HFC-32.

What is claimed:

1. A method for reducing the propagation of a flame to or from a refrigerant source and an ignition source spaced from said refrigerant source, comprising positioning a metal mesh flame arrestor between an exterior surface of said refrigerant source and said ignition source.

2. The method of claim 1, wherein said refrigerant source is an air conditioning system.

3. The method of claim 1, wherein said refrigerant source comprises one or more tetrafluoropropenes and the arrestor reduces the propagation of a flame exposed to said tetrafluoropropenes.

4. The method of claim 3, wherein said refrigerant comprises a mixture of one or more tetrafluoropropenes with difluoromethane or 1,1-difluoroethane.

5. The method of claim 3, wherein said tetrafluoropropenes comprise 2,3,3,3,-tetrafluoropropene; cis-1,3,3,3-tetrafluoropropene; trans-1,3,3,3-tetrafluoropropene; cis-1,2,3,3-tetrafluoropropene; trans-1,2,3,3,-tetrafluoropropene; 1,1,2,3-tetrafluoropropene; or 1,1,3,3-tetrafluoropropene or mixtures thereof.

6. The method of claim 1, wherein said refrigerant source comprises difluoromethane and the arrestor reduces the propagation of a flame exposed to said difluoromethane.

7. The method of claim 1, wherein said refrigerant source comprises 1,1-difluoroethane and the arrestor reduces the propagation of a flame exposed to said 1,1-difluoroethane.

8. The method of claim 1, wherein said metal mesh is 316 stainless steel, 304 stainless steel, carbon steel or aluminum.

9. The method of claim 8, wherein said metal mesh has an open area of about 60% or less.

10. The method of claim 8, wherein said metal mesh has an opening width of from about 0.2 mm to about 2.6 mm.

11. The method of claim 1, wherein said metal mesh is wrapped around the ignition source.

12. The method of claim 1, wherein two or more metal mesh flame arrestors are positioned and wherein the mesh holes of each arrestor are lined up in an offset position.

13. The method of claim 11, wherein said metal mesh partially conforms to an external shape of said ignition source.

14. The method of claim 1, wherein said metal mesh is immediately adjacent to said ignition source.

* * * * *